US007271718B2

(12) United States Patent
Jedlicka et al.

(10) Patent No.: US 7,271,718 B2
(45) Date of Patent: Sep. 18, 2007

(54) PROTECTION AGAINST LOSS OR THEFT OF IDENTIFICATION BADGES AND OTHER ITEMS

(75) Inventors: Timothy E. Jedlicka, Glen Ellyn, IL (US); George P. Wilkin, Bolingbrook, IL (US)

(73) Assignee: Lucent Technologies Inc., Murray Hill, NJ (US)

( * ) Notice: Subject to any disclaimer, the term of this patent is extended or adjusted under 35 U.S.C. 154(b) by 163 days.

(21) Appl. No.: 11/141,436

(22) Filed: May 31, 2005

(65) Prior Publication Data

US 2006/0267762 A1 Nov. 30, 2006

(51) Int. Cl.
*G08B 1/08* (2006.01)

(52) U.S. Cl. ..... 340/539.23; 340/573.4; 340/572.1

(58) Field of Classification Search ..... 340/573.1, 340/539.23, 527.1, 5.92, 539.1, 539.15, 10.51, 340/5.72, 539.01, 573.4; 235/385
See application file for complete search history.

(56) References Cited

U.S. PATENT DOCUMENTS 6,842,121 B1 * 1/2005 Tuttle ..... 340/693.9
7,005,985 B1 * 2/2006 Steeves ..... 340/572.1
7,015,817 B2 * 3/2006 Copley et al. ..... 340/573.4
7,116,230 B2 * 10/2006 Klowak ..... 340/572.1

OTHER PUBLICATIONS

NOKIA, Nokia Field Force Solution, May 23, 2005; pp. 1-2, http://nokia.com/nokia/0,,55737,00.html, USA.
Nokia, Nokia Mobile RFID Kit, May 23, 2005, pp. 1-2, file:// C:\DOCUME~1\HERNAN~1.PAT\LOCALS~1/ Temp\PWNWLSLC.htm.

* cited by examiner

*Primary Examiner*—Anh V. La

(57) ABSTRACT

An exemplary electronic apparatus monitors whether a security badge remains within an area proximate to the electronic apparatus in order to protect against loss or theft of the badge especially when the user is away from the secure environment for which the badge facilitates access. A transmitter periodically transmits a poll signal intended for reception by an RFID module attached to the badge, the poll signal having a predetermined magnitude to limit the effective reception range of the poll signal to the proximate area. A receiver can receive a reply signal generated by the RFID module in response to receipt of the poll signal where the reply signal includes identification information that is unique to the electronic device. The received identification information is compared with first identification information stored in memory of the electronic apparatus to determine if the received identification information matches the first identification information. An alert is transmitted if the identification information is not received that matches the first identification information.

17 Claims, 1 Drawing Sheet

PROTECTION AGAINST LOSS OR THEFT OF IDENTIFICATION BADGES AND OTHER ITEMS

BACKGROUND

This invention relates to protecting against loss or theft of portable items such as identification badges and is especially, but not exclusively, suited to immediately notify an owner if the portable item becomes separated by more than a short distance from another electronic device carried by the owner.

Protecting the security of buildings and facilities is a high priority in some environments. This is especially true for critical and high security environments such as government offices, military facilities and restricted areas of an airport. An identification badge with a photograph of the authorized person typically forms part of the process for restricting access. A lost or stolen badge creates a security risk. If the security personnel checking badges does not personally know the person presenting an authentic badge, an impostor who has or is made up to have a similar appearance to the person pictured on the badge could be granted access.

If an authorized user becomes aware that his badge has been lost or stolen, the authorized user can mitigate the security risk by informing appropriate security personnel who can then watch for a person presenting the badge or can invalidate the badge and issue the authorized user a new badge. However, a greater problem is presented when the authorized user is unaware that his badge has been stolen. For example, a thief seeking to steal a person's access badge might wait for an authorized user to enter an environment favorable to a pickpocket attempt such as a crowded train or bus. Then, the pickpocket or a team of pickpockets working together could distract the user and remove the badge from the user's coat pocket, purse or from a pocket of a laptop computer carry bag. Following an unnoticed theft of the badge, a security risk is posed until the authorized user becomes aware of the missing badge. If the theft of the badge occurs at the end of a workday, the authorized user may not become aware that the badge is gone until the following day. This provides the thief with an opportunity to seek access to the secured facility by using the stolen badge soon after the theft knowing that it is unlikely that the authorized user will become aware of the missing badge for some time. Therefore, there exists a need to provide increased security addressing the unnoticed theft of personal badges.

SUMMARY

It is an object of the present invention to satisfy this need.

An exemplary electronic apparatus monitors whether a security badge remains within an area proximate to the electronic apparatus in order to protect against loss or theft of the badge especially when the user is away from the secure environment for which the badge facilitates access. A transmitter periodically transmits a poll signal intended for reception by a radio frequency identification (RFID) module attached to the badge, the poll signal having a predetermined magnitude to limit the effective reception range of the poll signal to the proximate area. A receiver can receive a reply signal generated by the RFID module in response to receipt of the poll signal where the reply signal includes identification information that is unique to the electronic device. The received identification information is compared with first identification information stored in memory of the electronic apparatus to determine if the received identification information matches the first identification information. An alert is transmitted if the identification information is not received that matches the first identification information.

The present invention also contemplates an exemplary method that provides protection of a badge based on maintaining periodic wireless contact between the badge and an electronic apparatus where both the badge and electronic apparatus are carried by the user outside of the secured environment.

DESCRIPTION OF THE DRAWINGS

Features of exemplary implementations of the invention will become apparent from the description, the claims, and the accompanying drawings in which:

DETAILED DESCRIPTION

One aspect of the present invention resides in the recognition of the difficulties associated with each person assigned a security badge being constantly vigilant in making sure that the user maintains possession of the badge. It is relatively easy to monitor that the badge is in the appropriate user's possession while the badge is being worn, i.e. the user is in the secured environment and the badge will typically be worn for display. This makes it easy for the user to periodically observe the badge. Since it is often a policy of entities associated with secured environments that the user should not display the badge outside of the secured environment, it becomes more difficult for the user to conveniently monitor the possession of the badge. Since users typically place badges in their coat pocket, purse, or pocket in a laptop carrying bag as they leave the secured environment, users may experience a false sense of security with regard maintaining possession of the badge. The present invention is especially, but not exclusively, suited for providing increased security with regard to maintaining possession of the badge outside of the secure environment.

Another aspect of the present invention resides in the recognition that many users working in a secure environment often carry one or more electronic devices in their possession as they travel to and from the workplace. It is also during the time of traveling to and especially from the workplace that it is most likely an attempted theft of their badge will occur. A recognition of the coincidence of these factors contributed to the concept of the present invention.

A summary of the concept of the present invention will be helpful in understanding the detailed description of an embodiment of the invention which follows. An RFID module or other device capable of responding to a wireless signal is attached to the badge. An electronic apparatus normally carried by the user while traveling to and from work such as a laptop computer, a cellular telephone or a personal digital assistant (PDA) is enabled to communicate with the electronic device attached to the badge. Electronic apparatus periodically polls the electronic device and monitors for a responding signal. The effective communication range between the electronic apparatus in the electronic device is intentionally limited to a predetermined distance, e.g. 20 feet. If the badge with the electronic device which cannot be easily decoupled from the badge is stolen by a pickpocket from the user, the electronic apparatus when outside of a proximate area will fail to receive a responding signal from the electronic device during the next poll and will initiate an appropriate action, e.g. providing an audible or visual alarm, or transmitting a predetermined security alert message. This periodic monitoring function can be disabled by the user such as while the user is at home or in the secure environment.

Figure 1:
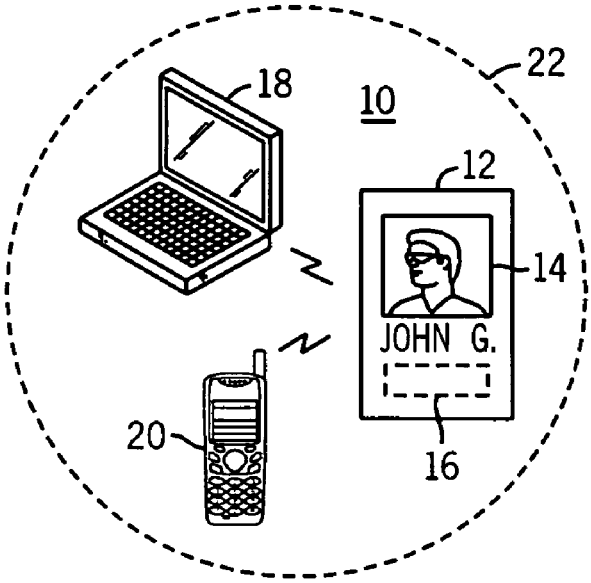
FIG. 1 is a block diagram of an exemplary system in accordance with the present invention.

FIG. 1 illustrates an exemplary system 10 with an identification badge 12 that includes an area 14 for a picture of the user to which the badge is issued. The badge may consist of a conventional identification badge made of plastic and may include known security features such as a hologram to protect against modification of the picture and barcode information. This badge includes in accordance with the embodiment of the present invention an electronic device or chip 16 such as an RFID chip mounted to the badge or otherwise integrated with the badge so that it cannot be removed from the badge without substantial disfigurement. The RFID chip transmits a unique identification code associated with the specific badge in response to receipt of an appropriate polling signal. Alternatively, the electronic device may automatically transmit a unique identification signal at continuously or at periodic intervals.

A laptop computer 18 is typically carried by the user to and from the secured environment as well as the user's badge 12. The laptop computer 18 includes an RFID communication link, i.e. the computer is adapted to generate a polling signal and to receive and decode a responding reply from the RFID chip 16 in badge 12. A known RFID reader can be integrated as part of the computer or inserted as a plug in module to the electronic apparatus, e.g. a USB coupled device. The computer is configured to cause the generation of a periodic polling signal, i.e. every 30 seconds, to which the RFID module is responsive and to await a predetermined reply from the RFID chip 16. The reply contains a unique identification for the module. The computer and/or the RFID reader contains a stored first identification to which the received identification from the module is compared. If the predetermined first identification is not received with the reply, the computer contains software that can be configured to initiate a variety of alerting actions. The computer may immediately generate a visual alert on the screen of the computer, generate an audible alarm sound, or both. Preferably the computer is programmed to take into account other factors in determining the type of alarm to be generated. For example, computer may generate only a visual alert on the screen of the computer if it is determined that the user is actively utilizing/accessing the computer. This would provide the user with an alert that would not be made known to the thief. If the user did not acknowledge the visual alert within a predetermined time or if the user was not determined to be accessing the computer, then additional alerts such as an audible alert and/or e-mail transmissions described below would be initiated.

The computer can be programmed to transmit one or a plurality of e-mail messages addressed to the user, security personnel at the secured environment, police, etc. assuming that the computer currently has Internet or other communication connectivity such as by a WI-FI hot spot or broader coverage wireless communications capability. The e-mail may contain stored predetermined text containing information about the user, the user's computer, and/or the user's badge. If such an e-mail is sent to security personnel at the secured environment, guards can be alerted to monitor for attempts to enter the facility by a person utilizing the subject badge or the badge can be immediately invalidated at the facilities security database. The e-mail alert can be configured to only be sent if the user fails to make a predetermined manual entry on the computer within a predetermined time of the communication of a first visual/audible alert.

In a preferred embodiment the laptop computer 18 includes software that provides the user with flexibility with regard to the badge monitoring function. For example, the user can manually activate and deactivate the monitoring function so that it is active only during appropriate times such as commuting to and from the secured environment. Alternatively, the software can configured to automatically engage the monitoring function during predetermined dates and time intervals during which the user is normally commuting to and from the secured environment. A computer enabled with global positioning satellite (GPS) or other location determining capabilities can be configured to automatically engage the badge monitoring function when it is sensed that the computer is moving from a predetermined location or is moving from the predetermined location in conjunction with a predetermined time interval. For example, the badge monitoring function could be activated upon determining that the laptop computer is leaving the user's home during a time at which the user normally leaves for work at the secured environment. The badge monitoring function could also be activated upon determining that the laptop computer is leaving the user's secured work location.

An electronic apparatus other than a laptop computer can be utilized to provide the monitoring functionality. For example, a cellular telephone 20 can be configured with an RFID communication link and corresponding software to provide the badge monitoring functionality similarly to that described above for the laptop computer. Since most modern cellular telephones can display information on a screen as well as accepting various inputs from the user, the same or similar functions as described above with regard to laptop 18 can be implemented utilizing cellular telephone 20. Likewise, a PDA can also be utilized to provide the badge monitoring functionality.

Area 22 represents the limited area in which communications utilizing the RFID link are effective. That has, the electronic apparatus providing the badge monitoring function and the badge was not be separated greater than a distance represented by area 22 in order to prevent the alarm(s) from being activated. It will be apparent to those skilled in the art that the exact distance associated with area 22 is not critical. However, this distance should not be made so small as to be inconvenient for the user. For example, if the distance were limited to 3 feet, then an undesired alarm might be triggered if the user placed his laptop computer in the backseat of a car while the badge was in the user's pocket in the front seat of the car. On the other hand, the distance should not be made so great as to render the alarm function ineffective. For example, if the effective communication distance was 1 mile, then it is conceivable that a thief could steal the badge without being noticed by the user as the user left the secured environment and be able to utilize the stolen badge to attempt entry into the secured environment while the user (the user's laptop and/or savor telephone) was still within the 1 mile range.

Similarly, the periodic polling interval should be selected with care. This time intervals should be selected so as not to be so long as to give a thief too much time in which to act. On the other hand, a time interval should not be selected to be so short so as to cause unnecessary battery drain or computational load on the electronic apparatus carrying out the badge monitoring function.

Figure 2:
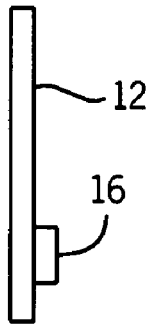
FIG. 2 is a side view of the exemplary badge of FIG. 1.

FIG. 2 shows a side view of the illustrative badge 12 with an attached RFID chip 16. Of course, the chip could be embedded within the body of the badge if desired.

Figure 3:
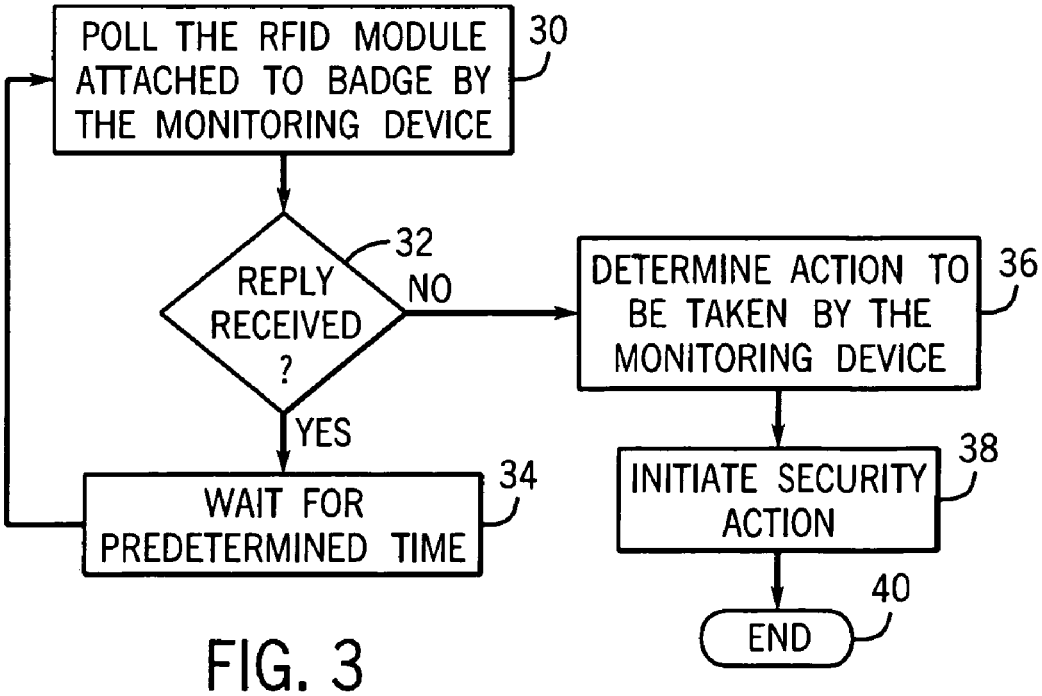
FIG. 3 is a flow diagram of steps in an exemplary method in accordance with the present invention.

FIG. 3 is a flow diagram of steps in accordance with an illustrative method in accordance with the present invention. In step 30 the electronic apparatus polls the RFID module attached to the badge. A determination is made in step 32 by the electronic apparatus of whether a reply to the poll has been received from the badge. A YES determination results in the electronic apparatus waiting for a predetermined time as indicated in step 34. Following this waiting period, process continues by returning to step 30. Thus, these steps form a continuous loop of polls being sent by the electronic apparatus followed by appropriate replies transmitted from the badge being received by the electronic apparatus. This sequence is interpreted by the electronic apparatus as the badge being within the appropriate distance of the electronic apparatus during the badge monitoring function and hence there is no potential theft or loss issue for which an alarm is required.

A NO determination by step 32 indicates that a reply was not received by the electronic apparatus from the badge response to a previously transmitted poll. This causes the electronic apparatus to determine the action to be taken in view of the lack of an appropriate reply in step 36. As explained above, a variety of actions can be taken depending upon the desire of the user and of the level of security and communications desired by the secured environment. Of course, more than one action can be taken. In accordance with step 38 the programmed security action is initiated. The process terminates at END step 40.

Although exemplary implementations of the invention have been depicted and described in detail herein, it will be apparent to those skilled in the art that various modifications, additions, substitutions, and the like can be made without departing from the spirit of the invention. For example, in order to eliminate a potentially false alert due to a momentary loss of the communication link between the electronic apparatus and the badge, more than one failed reply can be required in order to trigger an alert. Instead of the electronic apparatus providing periodic polling of the electronic device, an electronic device can be capable of generating periodic and/or continuous transmissions thereby requiring that the electronic apparatus only be capable of receiving the transmissions initiated from the electronic device. It will be apparent to those skilled in the art that the embodiments of the present invention are applicable to other environments in which it is desired to monitor whether a person or object remains within a reasonable distance from another person, especially where the person desiring the monitoring function can move from place to place. For example, a parent could desire to monitor whether a small child remains within the vicinity of the parent. This could be accomplished by appending a badge or object containing the electronic device to the child while the parent carries a device implementing the electronic apparatus function.

In the basic implementation an alarm is generated based on the separation of the electronic apparatus and the electronic device. That is, if a thief stole the user's laptop and the user maintained his badge in the user's coat pocket, the laptop would implement the electronic apparatus function and cause an alarm to be generated (assuming of course that the laptop remains sufficiently operational and functioning to generate the alarm). Therefore, an implementation of the present invention can also serve a reverse role of providing protection in the form of an alarm in the case of the loss or theft of the electronic apparatus.

The scope of the invention is defined in the following claims.

We claim:

1. An electronic apparatus for monitoring whether an electronic device remains within an area proximate to the electronic apparatus, the electronic apparatus comprising:

a transmitter adapted top periodically transmit a poll signal intended for reception by the electronic device, the transmitter transmitting the poll signal with a predetermined magnitude to limit the effective reception range of the poll signal to said area;

a receiver adapted to receive a reply signal generated by the electronic device in response to receipt of the poll signal where the reply signal includes identification information that is unique to the electronic device;

means for comparing the received identification information with first identification information stored in memory of the electronic apparatus to determine if the received identification information matches the first identification information;

means for transmitting an alert if the identification information is not received that matches the first identification information following the transmission of the poll signal by the transmitter;

wherein the electronic apparatus is capable of being accessed by a user and further comprises means for determining whether the electronic apparatus is being currently accessed by the user, the first alert consisting of visual indicia if the determining means determines that the electronic apparatus is being currently accessed by the user, the first alert comprising an audible sound if the determining means determines that the electronic apparatus is not being currently accessed by the user.

2. The electronic apparatus of claim 1 wherein the electronic apparatus further comprises a laptop computer adapted to communicate the first alert to the user of the laptop computer.

3. The electronic apparatus of claim 2 wherein the laptop computer is adapted to automatically generate a second alert comprising a wireless, transmission of an e-mail message to a predetermined site that maintains security associated with the electronic device and electronic apparatus.

4. The electronic apparatus of claim 3 wherein the laptop computer generates the second alert only if a manual input from the user of the laptop computer is not entered on the laptop computer within a predetermined time of the communication of the first alert.

5. The electronic apparatus of claim 1 wherein the electronic device comprises a security badge.

6. The electronic apparatus of claim 5 wherein the security badge includes a radio frequency identification (RFID) module that is responsive to receipt of the poll signal.

7. An electronic apparatus for monitoring whether an electronic device remains within an area proximate to the electronic apparatus, the electronic apparatus comprising:

a transmitter adapted to periodically transmit a poll signal intended for reception by the electronic device, the transmitter transmitting the poll signal with a predetermined magnitude to limit the effective reception range of the poll signal to said area;

a receiver adapted to receive a reply signal generated by the electronic device in response to receipt of the poll signal where the reply signal includes identification information that is unique to the electronic device;

means for comparing the received identification information with first identification information stored in memory of the electronic apparatus to determine if the received identification information matches the first identification information;

means for transmitting an alert if the identification information is not received that matches the first identification information following the transmission of the poll signal by the transmitter;

wherein the electronic apparatus comprises a cellular telephone and further comprises means for determining whether the cellular telephone is being currently accessed by the user, the first alert consisting of visual indicia if the determining means determines that the cellular telephone is being currently accessed by the user, the first alert comprising an audible sound if the determining means determines that the cellular telephone is not being currently accessed by the user.

8. The electronic apparatus of claim 7 wherein the cellular telephone is adapted to automatically generate a second alert comprising a wireless transmission to a predetermined site that maintains security associated with the electronic device and electronic apparatus.

9. The electronic apparatus of claim 7 wherein the cellular telephone generates the second alert only if a manual input from the user of the cellular telephone is not entered on the cellular telephone within a predetermined time of the communication of the first alert.

10. A method for monitoring loss or the of a security badge being carried by a user outside of a secured environment for which the badge facilitates access comprising the steps of:

periodically generating a poll signal from an electronic apparatus being carried by the user outside of the secured environment;

receiving a reply signal by the electronic apparatus from radio frequency identification (RFID) module attached to the security badge in response to receipt to the poll signal where the reply signal includes identification information that is unique to the security badge;

comparing by the electronic apparatus the received identification information with first identification information stored in memory of the electronic apparatus to determine if the received identification information matches the first identification information;

transmitting an alert if the identification information is not received that matches the first identification information following the transmission of the poll signal;

determining by the electronic apparatus whether the latter is being currently accessed by the user, the first alert consisting of visual indicia if it is determined that the electronic apparatus is being currently accessed by the user, the first alert comprising an audible sound if it is determined that the electronic apparatus is not being currently accessed by the user.

11. The method of claim 10 wherein the electronic apparatus comprises a laptop computer, the method further comprising using the laptop computer adapted to communicate the first alert to the user of the laptop computer.

12. The method of claim 11 further comprising automatically generating a second alert by the laptop computer where, the second alert comprises a wireless transmission of an e-mail message to a predetermined site that maintains security associated with the security badge.

13. The method of claim 12 further comprising generating the second alert only if a manual input from the user of the laptop computer is not entered on the laptop computer within a predetermined time of the communication of the first alert.

14. The method of claim 10 wherein the electronic apparatus comprises a cellular telephone, the method further comprising using the cellular telephone adapted to communicate the first alert to the user of the cellular telephone.

15. The method of claim 14 further comprising determining by the cellular telephone whether the latter is being currently accessed by the user, the first alert consisting of visual indicia if it is determined that the cellular telephone is being currently accessed by the user, the first alert comprising an audible sound if it is determined that the cellular telephone is not being currently accessed by the user.

16. The method of claim 14 further comprising automatically generating a second alert by the cellular telephone where the second alert comprises a wireless transmission of an e-mail message to a predetermined site that maintains security associated with the security badge.

17. The method of claim 16 further comprising automatically generating the second alert only if a manual input from the user of the cellular telephone is not entered on the cellular telephone within a predetermined time of the communication of the first alert.

* * * * *